US007735644B2

(12) United States Patent
Sirichai et al.

(10) Patent No.: US 7,735,644 B2
(45) Date of Patent: Jun. 15, 2010

(54) CASE FOR ELECTRICAL DEVICE AND METHOD OF USING SAME

(75) Inventors: Saharut Sirichai, Hong Kong (HK); Xin Fu, Shanghai (CN)

(73) Assignee: Belkin International, Inc., Playa Vista, CA (US)

( * ) Notice: Subject to any disclaimer, the term of this patent is extended or adjusted under 35 U.S.C. 154(b) by 142 days.

(21) Appl. No.: 11/810,823

(22) Filed: Jun. 6, 2007

(65) Prior Publication Data

US 2008/0302687 A1 Dec. 11, 2008

(51) Int. Cl.
*B65D 85/00* (2006.01)

(52) U.S. Cl. ..... 206/320; 206/45.24; 206/45.2

(58) Field of Classification Search ..... 206/320, 206/701, 305, 37, 38, 760, 759, 45.2, 45.24; 224/930, 929; 361/683–686, 679, 600; 150/165; 248/444.1, 454–457, 447–448, 459
See application file for complete search history.

(56) References Cited

U.S. PATENT DOCUMENTS

| | | | | | |
|---|---|---|---|---|---|
| 1,659,395 | A * | 2/1928 | Douglas | 402/70 |
| 1,863,047 | A * | 6/1932 | Grimsley | 206/760 |
| 3,769,741 | A * | 11/1973 | Hessler et al. | 206/750 |
| 4,213,520 | A * | 7/1980 | Sarna et al. | 248/444.1 |
| 4,259,568 | A * | 3/1981 | Dynesen | 206/305 |
| 4,400,161 | A * | 8/1983 | Gerlt | 206/760 |
| 4,467,551 | A * | 8/1984 | Pulver | 206/315.1 |
| 4,544,123 | A * | 10/1985 | Peacock | 248/460 |
| 4,663,880 | A * | 5/1987 | Grobl | 43/17.6 |
| 4,703,161 | A * | 10/1987 | McLean | 361/680 |
| 4,896,805 | A | 1/1990 | Klaczak et al. | |
| 5,607,054 | A * | 3/1997 | Hollingsworth | 206/320 |
| 5,887,723 | A * | 3/1999 | Myles et al. | 206/320 |
| 5,913,683 | A * | 6/1999 | Rahmoune et al. | 434/104 |
| 6,604,618 | B1 * | 8/2003 | Godshaw et al. | 206/320 |
| 6,697,045 | B2 * | 2/2004 | Min | 345/156 |
| 7,104,516 | B2 * | 9/2006 | Uto et al. | 248/688 |
| 2005/0098594 | A1 * | 5/2005 | Truong | 224/275 |
| 2005/0247584 | A1 * | 11/2005 | Lu | 206/320 |
| 2006/0243772 | A1 | 11/2006 | Sirichai et al. | |

OTHER PUBLICATIONS

U.S. Appl. No. 11/706,664, filed Feb. 12, 2007, James Chan.
U.S. Appl. No. 11/391,796, filed Mar. 28, 2006, Sirichai et al.

* cited by examiner

*Primary Examiner*—Ehud Gartenberg
*Assistant Examiner*—Andrew Perreault
(74) *Attorney, Agent, or Firm*—Bryan Cave LLP

(57) ABSTRACT

A case (100) for an electrical device includes: (a) a first portion (110) with a bottom surface (111); (b) a second portion (121) adjacent to the first portion; (c) a third portion (122) adjacent to the second portion; (d) a fourth portion (123) adjacent to the third portion; and (e) a fifth portion (132) with an interior surface (235) and adjacent to the fourth portion. In this embodiment, at least one of the first portion or the third portion is configured to be removably coupled to the electrical device. Additionally, when the case placed in an open configuration, the first portion is capable of being located over the fifth portion with the bottom surface of the first portion adjacent to the interior surface of the fifth portion.

16 Claims, 6 Drawing Sheets

100

FIG. 3
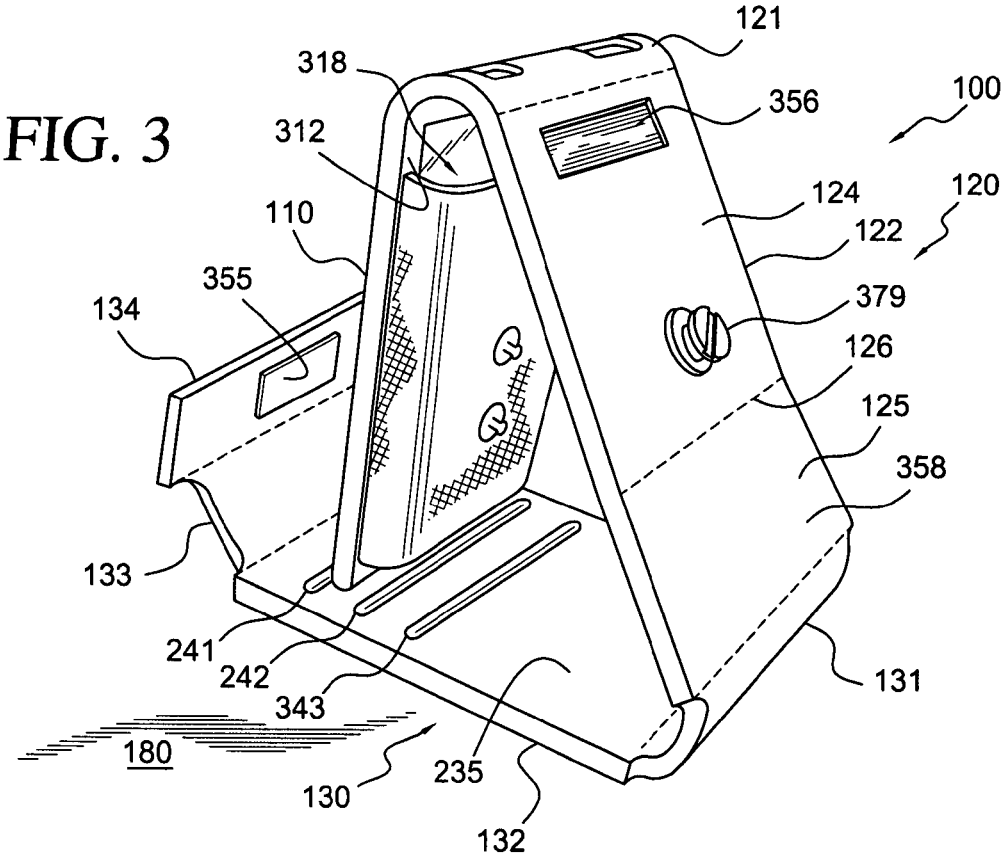
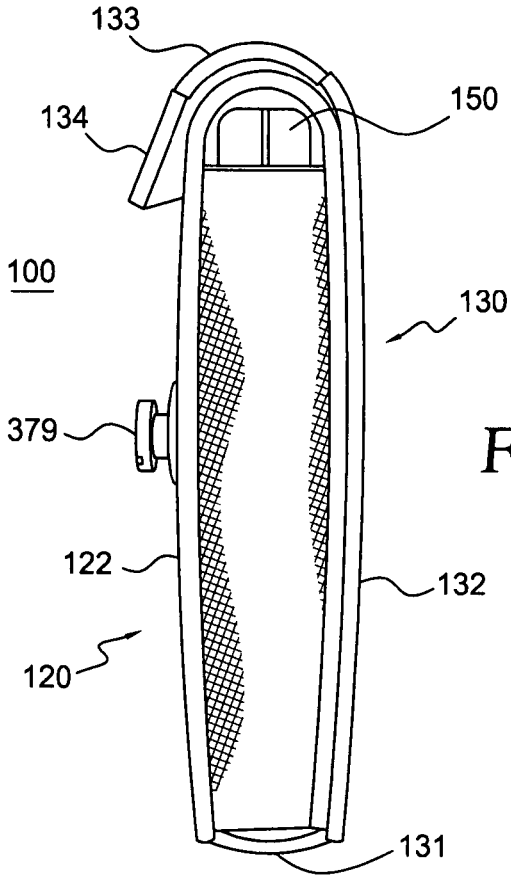
FIG. 4

100

CASE FOR ELECTRICAL DEVICE AND METHOD OF USING SAME

FIELD OF THE INVENTION

This invention relates generally to cases for electrical devices, and relates more particularly to such cases that provide easy access to and protection of electrical devices and methods of using the same.

BACKGROUND OF THE INVENTION

Advancing technology has made portable electrical devices increasingly popular and has given such electrical devices an ever-increasing array of capabilities. Some electrical devices, such as digital music and video players, cellular phones, personal digital assistants, handheld digital computers, and the like, include the capability to display images or videos. While it is possible to view the images or videos while holding such video-capable devices in one's hand, it would often be more convenient and more comfortable to set down such electrical devices and have them maintain a position in which the images and videos can be viewed easily.

Furthermore, most portable electrical devices include display or touch screens and/or control mechanisms. It would be convenient for the user of such electrical devices if a protective case allowed easy viewing of the display screen from a distance and operation of the electrical device, without requiring the user to hold the electrical device or remove it from the case.

Accordingly, a need exists for a case for an electrical device that both protects the electrical device and allows it to maintain a hands-free operating and viewing position.

BRIEF DESCRIPTION OF THE DRAWINGS

The invention will be better understood from a reading of the following detailed description of examples of embodiments, taken in conjunction with the accompanying figures in the drawings in which:

FIG. 3 illustrates a top, back, side isometric view of the case of FIG. 1 in a third embodiment of an open configuration, according to the first embodiment of the case;

FIG. 4 illustrates a side view of the case of FIG. 1 in a closed configuration and enclosing the electrical device of FIG. 1, according to the first embodiment of the case;

Figure 1:
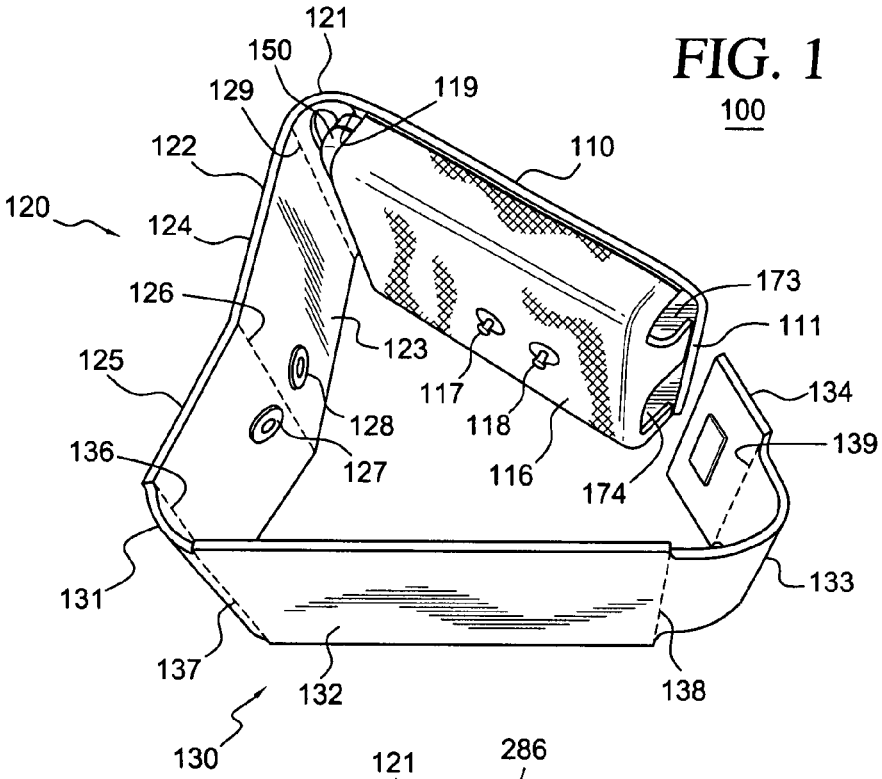
FIG. 1 illustrates a bottom, side isometric view of a case in a first embodiment of an open configuration and enclosing an electrical device, according to a first embodiment of the case.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

DETAILED DESCRIPTION OF EXAMPLES OF EMBODIMENTS

In a number of embodiments, a case for an electrical device can include: (a) a first portion with a bottom surface; (b) a second portion adjacent to the first portion; (c) a third portion adjacent to the second portion; (d) a fourth portion adjacent to the third portion; and (e) a fifth portion with an interior surface and adjacent to the fourth portion. In this embodiment, at least one of the first portion or the third portion is configured to be removably coupled to the electrical device. Additionally, when the case is placed in an open configuration, the first portion is capable of being located over the fifth portion with the bottom surface of the first portion adjacent to the interior surface of the fifth portion.

In other embodiments, a holder for an electrical device can include: (a) an inner section with a bottom surface; (b) a first outer section adjacent to the inner section; (c) a second outer section with a first surface and adjacent to the first outer section; and (d) one or more ribs adjacent to the first surface of the second outer section. In these embodiments, the holder is configured to be removably coupled to the electrical device. Furthermore, the holder is configured to be placed in a position such that the inner section forming a substantially non-zero angle with the second outer section and the bottom surface of the inner section is at least partially supported by the first surface of the second outer section and one rib of the one or more ribs.

In yet another embodiment, a method of using a case with an electrical device includes: (a) providing the case to comprise: (1) a first portion with a bottom surface; (2) a second portion adjacent to the first portion; (3) a third portion adjacent to the second portion; (4) a fourth portion adjacent to the third portion; and (5) a fifth portion with an interior surface adjacent to the fourth portion; (b) coupling the electrical device to the case at the first portion; (c) placing the case in an open configuration with the bottom surface of the first portion over and adjacent to the interior surface of the fifth portion.

Figure 2:
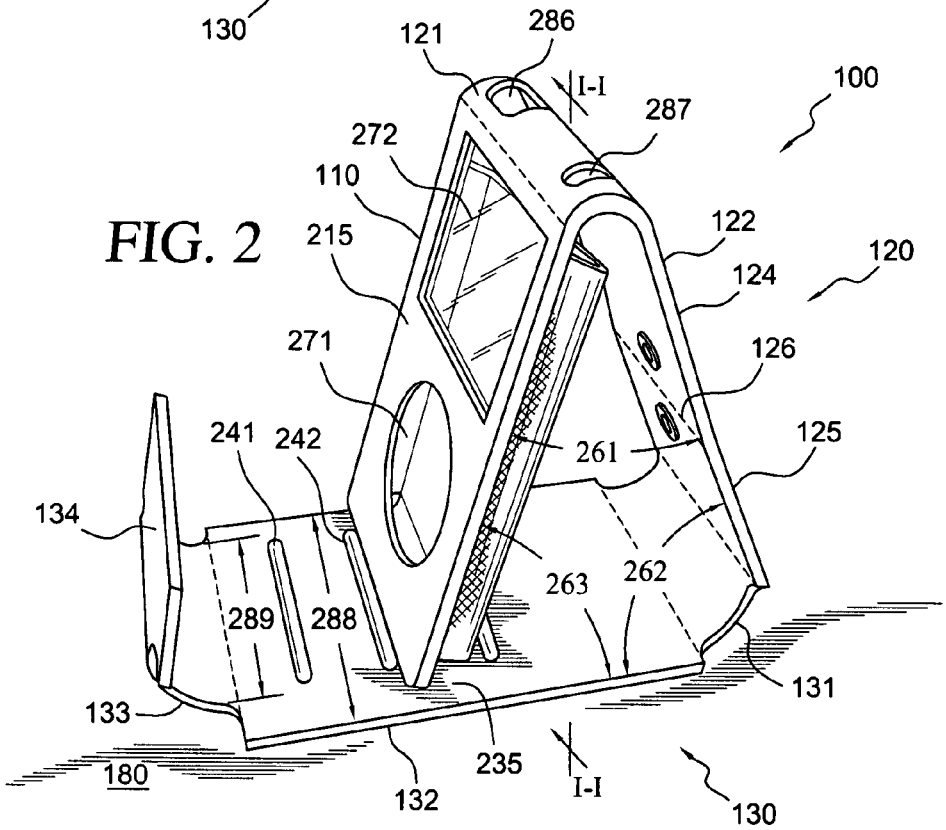
FIG. 2 illustrates a top, front, side isometric view of the case of FIG. 1 in a second embodiment of an open configuration, according to the first embodiment of the case.

Turning to the drawings, FIG. 1 illustrates a bottom, side isometric view of a case 100 in a first embodiment of an open configuration and enclosing an electrical device 150, according to a first embodiment of case 100. FIG. 2 illustrates a top, front, side isometric view of case 100 in a second embodiment of an open configuration, according to the first embodiment of case 100. FIG. 3 illustrates top, back, side isometric view of case 100 in a third embodiment of the open configuration, according to the first embodiment of case 100. FIG. 4 illustrates a side view of case 100 in a closed configuration and enclosing electrical device 150, according to the first embodiment of case 100. Case 100 is merely exemplary and is not limited to the embodiments presented herein. Case 100 can be employed in many different embodiments or examples not specifically depicted or described herein.

In some embodiments, a holder or case 100 for electrical device 150 can include: (a) an inner portion 110 with a bottom surface 111; (b) an outer section 120 adjacent to inner portion 110; (c) an outer section 130 adjacent to outer section 120; and (d) one or more supports or ribs 241, 242, and 343 adjacent to outer section 130.

In some embodiments, case 100 can also include a connector 379 at an exterior surface 358 of outer section 120. As an example, connector 379 can be configured to couple to a clip (not shown) on a belt.

Case 100 is configured to be removably coupled to electrical device 150. In one example, inner portion 110 is configured to be coupled to electrical device 150. In alternative embodiments, outer section 120 is configured to be coupled to electrical device 150.

In one embodiment, outer section 120 can include: (a) a portion 121 adjacent to inner portion 110; and (b) a portion 122 adjacent to portion 121. Portion 122 can include an interior surface 123.

In various embodiments, at least a part of inner portion 110 can be contiguous with and/or continuous with at least a part of portion 121. Likewise, at least a part of portion 121 can be contiguous with and/or continuous with at least a part of portion 122. Furthermore, in some embodiments, inner portion 110 can be coupled to portion 121 at or by a hinge 119 with inner portion 110 and portion 121 configured to be folded along hinge 119. Likewise, portion 121 can be coupled to portion 122 at or by a hinge 129 with portions 121 and 122 configured to be folded along hinge 129.

In the same or a different embodiment, outer section 130 can include: (a) a portion 131 adjacent to portion 122; (b) a portion 132 with an interior surface 235 and adjacent to portion 131; (c) a portion 133 adjacent to portion 132; and (d) a portion 134 adjacent to portion 133. In one embodiment, ribs 241, 242, and 343 are adjacent to interior surface 235.

In many embodiments, at least a part of portion 131 can be contiguous with and/or continuous with at least a part of portion 122. Likewise, at least a part of portion 131 can be contiguous with and/or continuous with at least a part of portion 132. In the same or different embodiments, at least a part of portion 132 can be contiguous with and/or continuous with at least a part of portion 133. Additionally, in some embodiments, at least a part of portion 133 can be contiguous with and/or continuous with at least a part of portion 134.

In some examples, portion 122 can be coupled to portion 131 at or by a hinge 136 with portions 122 and 131 configured to be folded along hinge 136. Likewise, portion 131 can be coupled to portion 132 at or by a hinge 137 with portions 131 and 132 configured to be folded along hinge 137. In the same or different embodiments, portion 132 can be coupled to portion 133 at or by a hinge 138 with portions 132 and 133 configured to be folded along hinge 138. In some embodiments, portion 133 can be coupled to portion 134 at or by a hinge 139 with portions 133 and 134 configured to be folded along hinge 139. In some embodiments, hinges 119, 129, 136, 137, 138, and/or 139 are rows of stitching that extend across the width of case 100. In other embodiments, hinges 119, 129, 136, 137, 138, and/or 139 are fold lines or a region where two different materials are coupled together. In still other embodiments, case 100 does not include some of or any of hinges 119, 129, 136, 137, 138, or 139, and one or more of portions 121, 131, and 133 serve as the hinges.

In some embodiments, portion 132 can have a width 288, and portion 133 can have a width 289. In some examples, width 289 is less than width 288. For example, width 288 can be four to ten centimeters, and width 289 can be two to six centimeters. In a preferred example, width 288 is approximately six and a half centimeters, and width 289 is approximately five centimeters. Likewise, widths of portions 110, 121, 122, 131, 132, and 134 can be the same at four to ten centimeters. In a preferred example, widths of portions 110, 121, 122, and 132 are each also six and a half centimeters, and width of portion 131 is approximately five and a half centimeters.

In the same or different embodiments, width 289 is less than width 288, and portion 121 can have at least one aperture 287 to allow a user access to electrical device 150 when case 100 is in a closed configuration. Portion 121 can also allow the user access to electrical device 150 though aperture 287 and one or more apertures 286 when case 100 is in an open configuration.

Case 100 is configured to be placed in open or closed configurations. FIG. 1 illustrates case 100 in a first embodiment of the open configuration. FIGS. 2 and 3 illustrate case 100 in second and third embodiments of the open configuration on a flat surface 180, and FIG. 4 illustrates case 100 in the closed configuration. In the illustrated embodiments, when case 100 is in a closed configuration, outer section 130 wraps around inner portion 110 such that an exterior surface 215 of inner portion 110 contacts and/or is adjacent to interior surface 235.

In some embodiments, electrical device 150 includes: (a) a first side (not shown); (b) a second side (not shown) opposite the first side; and (c) a third side (not shown) adjacent to the first side and the second side. In various examples, the second side of electrical device 150 can include a video screen and/or a control mechanism. When case 100 is placed in a closed configuration and encases electrical device 150, portion 121 is adjacent to the third side of electrical device 150, portion 122 is adjacent to the first side of electrical device 150, and inner portion 110 is adjacent to the second side of electrical device 150.

In some examples, portion 134 can include a coupling mechanism 355, and portion 122 can include a coupling mechanism 356, as shown in FIG. 3. Coupling mechanism 355 can be designed to be coupled to coupling mechanism 356. In some embodiments, attaching coupling mechanisms 355 and 356 to each other secures case 100 in a closed configuration. In alternative embodiments, portion 133 includes a first coupling mechanism and portion 121 includes a second coupling mechanism. In this alternative embodiment, the first coupling mechanism is configured to be coupled to the second coupling mechanism to secure case 100 in a closed configuration.

In some embodiments, coupling mechanism 355 can include one or more connectors that can be coupled to one or more of complementary connectors forming coupling mechanism 356. In one embodiment, coupling mechanisms 355 and 356 are complementary Velcro® material. In other embodiments, coupling mechanisms 355 and 356 can be buttons, string ties, or the like. In some examples, coupling mechanisms 355 and 356 can also contain magnets to help align and couple coupling mechanisms 355 and 356.

In various embodiments, as shown in FIGS. 2 and 3, when case 100 is in the open configuration, the case is configured to be placed in a position such that bottom surface 111 is at least partially supported by interior surface 235 and at least one rib of ribs 241, 242, and 343. Moreover, in this configuration, inner portion 110 forms a non-zero angle 261 with portion 122; portion 122 forms a non-zero angle 262 with portion 132; and portion 132 forms a non-zero angle 263 with inner portion 110. In some embodiments, angles 261, 262, and 263 can be acute angles of a single triangle.

In one example, when bottom surface 111 is partially supported by rib 343, angle 261 can be approximately 30 degrees; angle 262 can be approximately 75 degrees; and angle 263 can be approximately 75 degrees. In the same or a different example, as shown in FIG. 2, when bottom surface 111 is partially supported by rib 242, angle 261 can be approximately 40 degrees; angle 262 can be approximately 70 degrees; and angle 263 can be approximately 70 degrees. Likewise, as shown in FIG. 3, when bottom surface 111 is partially supported by rib 241, angle 261 can be approximately 50 degrees; angle 262 can be approximately 65 degrees; and angle 263 can be approximately 65 degrees.

In other examples, angles 261, 262, and/or 263 are set such that inner portion 110 is at a comfortable viewing or operating position for a user of electrical device 150. In some embodiments, angles 261, 262, and/or 263 can be fixed to complement the features of electrical device 150. For example, if electrical device 150 is mostly used for viewing images or videos, angles 261, 262, and 263 can be different than if the user's interaction with electrical device 150 is mainly to change settings on a touch screen of electrical device 150.

In the same or different examples, portion 121 and portion 132 can provide support to inner portion 110 when case 100 is in the open configuration and inner portion 110 is located over portion 132 with bottom surface 111 adjacent to interior surface 235.

Referring again to FIGS. 1-4, inner portion 110 can include: (a)bottom surface 111; (b) an interior surface 312 adjacent to bottom surface 111; (c) exterior surface 215 adjacent to bottom surface 111 and opposite interior surface 312; and (d) a coupling mechanism 116 at interior surface 312. In some embodiments, when case 100 is placed in a closed configuration, exterior surface 215 is substantially parallel and/or adjacent to interior surface 235.

In some examples, interior surface 312 is configured to be removably coupled to electrical device 150. In one embodiment, interior surface 312 is removably coupled to electrical device 150 using coupling mechanism 116.

Coupling mechanism 116 can be configured to removably enclose electrical device 150. In some examples, coupling mechanism 116 can be a pocket. When coupling mechanism 116 is a pocket, electrical device 150 can be placed inside of coupling mechanism 116 through an opening 318 in coupling mechanism 116. In one embodiment, coupling mechanism 116 is a piece of material sewn or otherwise attached to three sides of interior surface 312. Opening 318 can be located at the unattached side of the material. In some examples, opening 318 is located opposite to bottom surface 111. In some examples, coupling mechanism 116 can include one or more apertures 173 and 174 to allow the user access to portions of electrical device 150. In one embodiment, apertures 173 and 174 allow the user to connect peripheral devices such as headphones or power supplies to electrical device 150 without removing electrical device 150 from case 100. In alternative embodiments, coupling mechanism 116 can be Velcro® material, strings ties, buttons, or the like.

Inner portion 110 can allow a user to view and use electrical device 150 when electrical device 150 is coupled to interior surface 312 and case 100 is in the open configuration. In one example, inner portion 110 can include one or more openings 271 and 272 to allow the user to view and use electrical device 150. In some examples, opening 272 can be covered by a clear material. The clear material can allow the user to view and/or touch a display or touch screen at the second side of electrical device 150, while protecting the screen from damage. In one example, the clear material is a clear plastic, for example, clear polyvinyl chloride (PVC).

Figure 5:
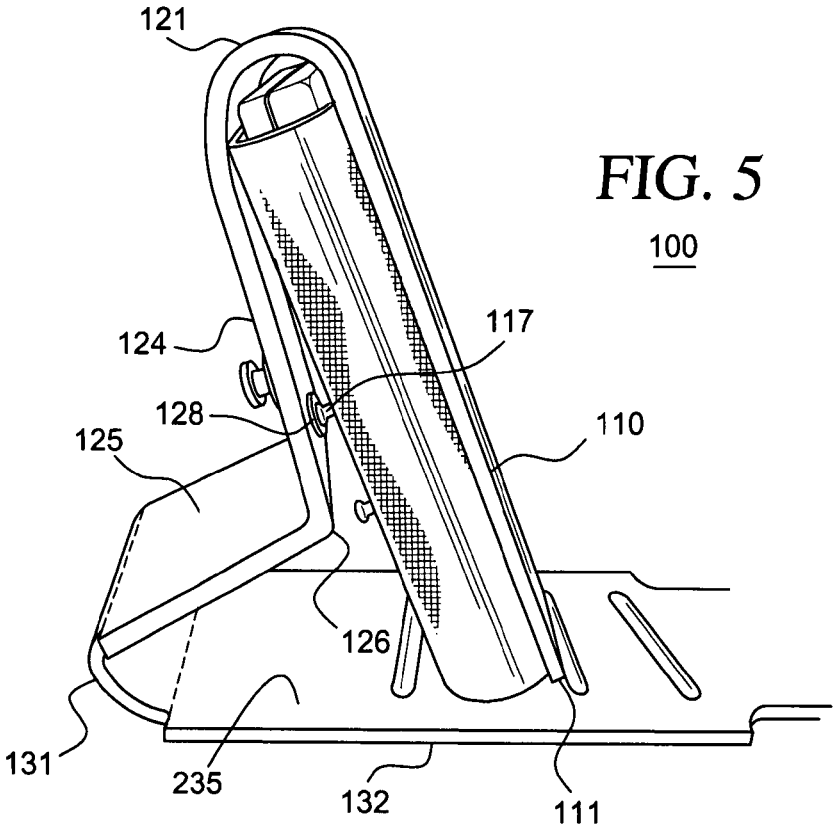
FIG. 5 illustrates another top, front, side isometric view of the case of FIG. 1 in a fourth embodiment of an open configuration and enclosing the electrical device of FIG. 1, according to the first embodiment of the case.

FIG. 5 illustrates a top, front, side isometric view of case 100 in a fourth embodiment of the open configuration, according to the first embodiment of case 100. As shown in FIGS. 1, 2, 3, and 5, portion 122 can include: (a) a segment 124 adjacent to portion 121; (b) a segment 125 adjacent to segment 124 and portion 131. In some examples, a bend region 126 separates and/or couples segment 124 from segment 125. Segment 124 is configured to be bent relative to segment 125 at bend region 126. In various examples, allowing segment 124 to be bent relative to segment 125 can increase the stability of case 100 when case 100 is in the open configuration and inner portion 110 is located over portion 132 with bottom surface 111 adjacent to interior surface 235.

In some embodiments, inner portion 110 can further include attachment mechanisms 117 and 118. In the same embodiment, portion 121 can include attachment mechanisms 127 and 128. Attachment mechanism 117 can include one or more connectors that can be coupled to one or more complementary connectors forming attachment mechanism 128. Likewise, attachment mechanism 118 can include one or more connectors that can be coupled to one or more complementary connectors forming attachment mechanism 127.

In one embodiment, attachment mechanisms 117 and 118 can be identical to or substantially similar to coupling mechanism 355. Moreover, attachment mechanisms 127 and 128 can be identical to or substantially similar to coupling mechanism 356.

In one example, attachment mechanisms 117 and 118 are adjacent to coupling mechanism 116. In the same or different embodiments, attachment mechanisms 127 and 128 are located at segments 125 and 124, respectively. In some examples, attachment mechanisms 117 and 118 can be male buttons, and attachment mechanisms 127 and 128 can be female buttons. In other embodiments, attachment mechanisms 117, 118, 127, and 128 are Velcro® material, strings ties, magnets, or the like.

Attachment mechanisms 117 and 118 can be coupled to attachment mechanisms 128 and 127, respectively, when case 100 is in a closed configuration. As shown in FIG. 5, attachment mechanism 117 can also be capable of being coupled to attachment mechanism 128 when case 100 is in open configuration and inner portion 110 is located over portion 132 with bottom surface 111 adjacent to interior surface 235. In some embodiments, segment 124 bends relative to segment 125 at bent region 126 when attachment mechanism 117 is coupled to attachment mechanism 128 and case 100 is in the open configuration with bottom surface 111 adjacent to interior surface 235. In alternative embodiments, attachment mechanisms 117 and 118 can both be coupled to attachment mechanisms 128 and 127, respectively, when case 100 is in the open configuration and inner portion 110 is located over portion 132 with bottom surface 111 adjacent to interior surface 235,.

Referring back to FIGS. 2 and 3, interior surface 235 of portion 132 can include ribs 241, 242, and 343. In some examples, one or more of ribs 241, 242, and 343 extend in first direction and are substantially parallel to each other. In various embodiments, the first direction is substantially parallel to width 288 of interior surface 235 embodiments. In some examples, ribs 241, 242, and 343 extend approximately 70 to 90 percent of width 288 and have a thickness of two to four millimeters.

In various embodiments, rib 241 is separated from rib 242 by approximately ten to twenty millimeters. For example, rib 241 can be separated from rib 242 by fifteen millimeters. In the same or different examples, rib 242 can be separated from rib 343 by ten to twenty millimeters. In some embodiments, the distance between ribs 241, 242, and 343 is set based on the dimensions of electrical device 150. In some examples, the distances between adjacent ribs are the same. In other embodiments, the distance between adjacent ribs varies.

Figure 6:
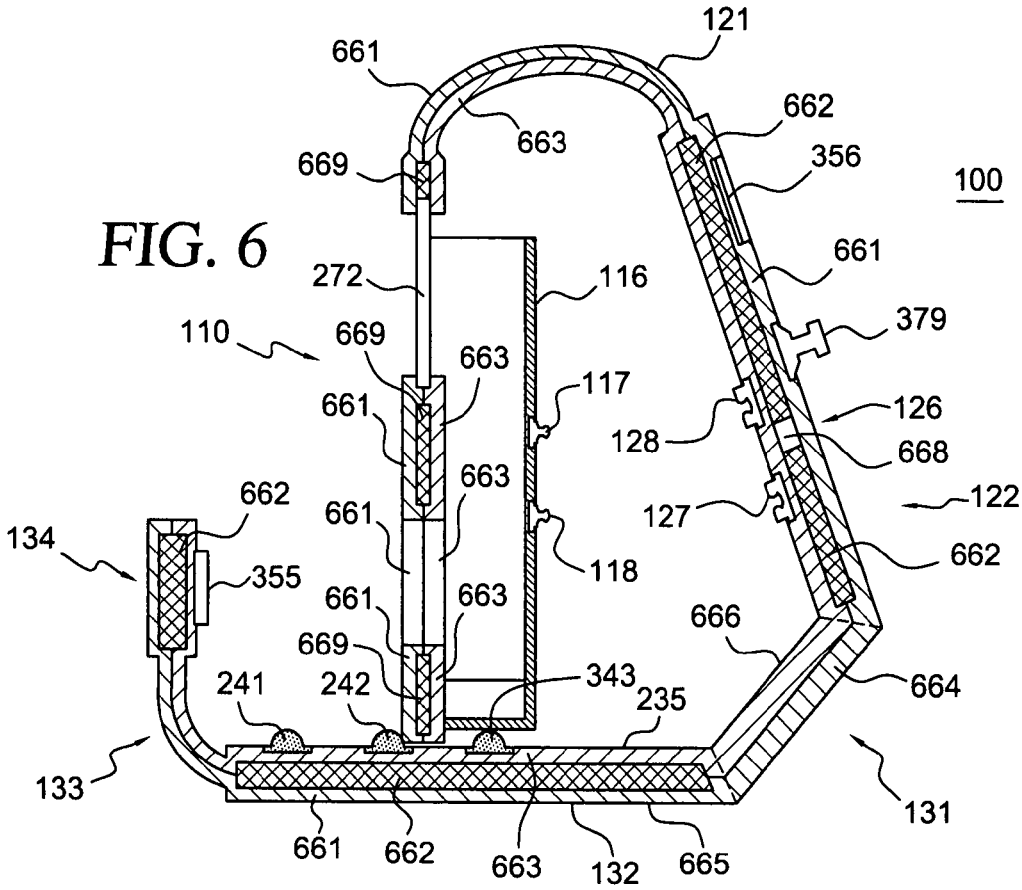
FIG. 6 illustrates a cross-sectional view along line I-I of FIG. 2 of the case of FIG. 1 in the second embodiment of an open configuration, according to the first embodiment of the case.

FIG. 6 illustrates a cross-sectional view along line I-I (FIG. 2) of case 100, according to the first embodiment of case 100. In the embodiment illustrated in FIG. 6, portion 132 can include: (a) an outer layer 661 with an exterior surface 665; (b) a stiffener layer 662 coupled to outer layer 661; (c) an inner layer 663 with interior surface 235 and coupled to stiffener layer 662.

In one embodiment, outer layer 661 and inner layer 663 can extend continuously through portions 133 and 134. However, in the embodiment illustrated in FIG. 6, portion 134 includes stiffener layer 662, but portion 133 does not include stiffener layer 662. In some examples, stiffener layer 662 is not present in portion 133 to allow easier folding of case 100 between the open and closed configurations.

In the embodiment illustrated in FIG. 6, portion 131 includes; (a) an inner layer 666; and (b) an outer layer 664. In some embodiments, inner layer 666 and outer layer 664 are made from different material than inner layer 663 and outer layer 661, respectively. In the same or a different embodiment, inner layer 666 and outer layer 664 are made from the same material. In alternative embodiments, portion 131 can include a stiffener layer. In the same or different examples, portion 131 can be made from the same material as coupling mechanism 116.

Portion 122 can include: (a) outer layer 661; (b) inner layer 663; and (c) stiffener layer 662 present throughout portion 122 except at bend region 126. In some embodiments, at bend region 126, a void region 668 exists between inner layer 663 and outer layer 661 to facilitate folding at bend region 126.

In the same or different embodiments, portion 121 can include: (a) outer layer 661; and (b) inner layer 663 coupled to outer layer 661. In alternative embodiments, portion 121 can include stiffener layer 662 between outer layer 661 and inner layer 663.

In inner portion 110, outer layer 661 and inner layer 663 can extend around the edges of openings 271 and 272. In some embodiments, inner portion 110 can include a stiffener layer 669. In many examples, stiffener layer 669 can be made from a different material than stiffener layer 662. For example, stiffener layer 662 can be composed of a material that provides more cushioning and protection than stiffener layer 669. In alternative embodiments, stiffener layers 662 and 669 can be made from the same material.

In an alternative example, portions 134, 132, 122, and/or 110 do not include a stiffener layer, or portions 110, 121, 122, 131, 132, 133, and 134 all include a stiffening layer. In yet another embodiment, inner portion 110, outer section 120, and/or outer section 130 are formed by a single layer (e.g., outer layer 661 or inner layer 663). In the same or different embodiments, coupling mechanism 116 can also include a stiffener layer.

Referring again to FIG. 6, outer layers 661 and 664 can be composed of a first material, and inner layers 663 and 666 can be composed of a second material. In some embodiments, outer layers 661 and 664 and inner layers 663 and 666 are made of leather (for example, split leather), suede, PVC, polyurethane, nylon, fabric, or the like. Stiffener layers 662 and 669 can be composed of cardboard, plastic, foam, or the like. In one example, stiffener layers 662 and 669 can include a layer of acrylonatrile butadiene styrene (ABS) and/or cardboard. In some embodiments, stiffener layers 662 and 669 lend rigidity and padding to case 100 to provide protection for electrical device 150 (FIGS. 1, 4, and 5).

In some examples, outer layer 661, stiffener layer 662, and inner layer 663 are stitched together. In other examples, some or all of outer layer 661, stiffener layer 662, and inner layer 663 can be attached together with an adhesive, for example, instead of or in addition to stitching.

Figure 7:
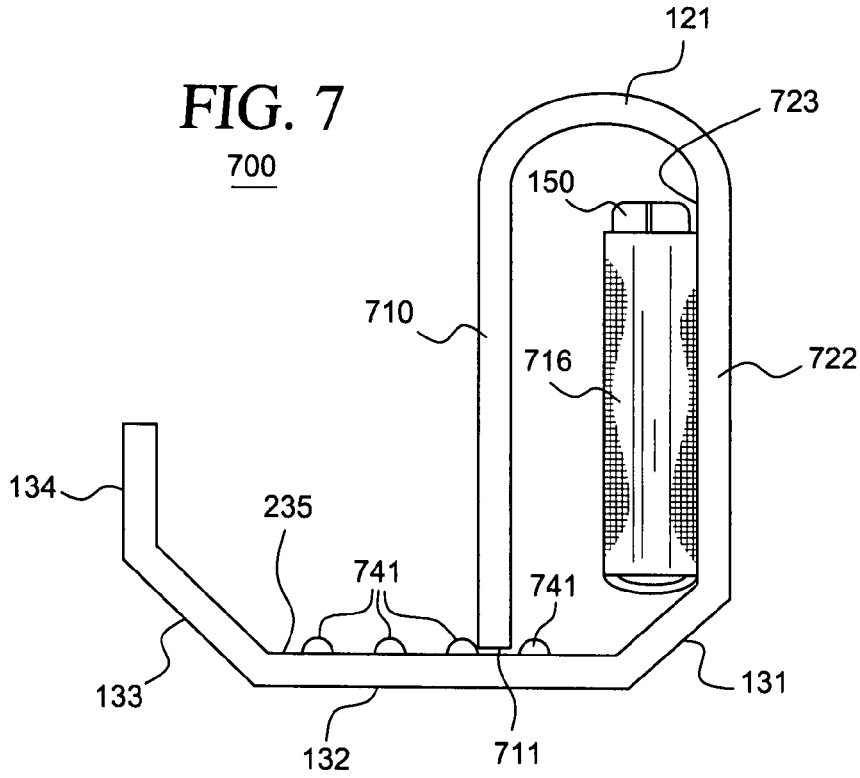
FIG. 7 illustrates a side view of a case in an open configuration and enclosing an electrical device, according to a second embodiment of the case.

Turning to another embodiment, FIG. 7 illustrates a side view of a case 700 in an open configuration and enclosing electrical device 150, according to a second embodiment of case 100 (FIG. 1). Case 700 can include: (a) an inner portion 710 with a bottom surface 711; (b) an outer potion 722; (c) portions 121, 131, 132, 133, and 134; and (d) at least four ribs 741 at portion 132. When case 700 is placed in an open configuration, inner portion 710 is capable of being located over portion 132 with bottom surface 711 adjacent to interior surface 235.

In this embodiment, outer portion 722 is configured to be removably coupled to electrical device 150. In the example illustrated in FIG. 7, outer portion 722 can include a coupling mechanism 716 (e.g., a pocket) at an interior surface 723. In one example, coupling mechanism 716 can be identical to or substantially similar to coupling mechanism 116 (FIG. 1). In some embodiments, outer portion 722 can include openings (not shown) identical to or substantially similar to openings 271 and 272 (FIG. 2).

Figure 8:
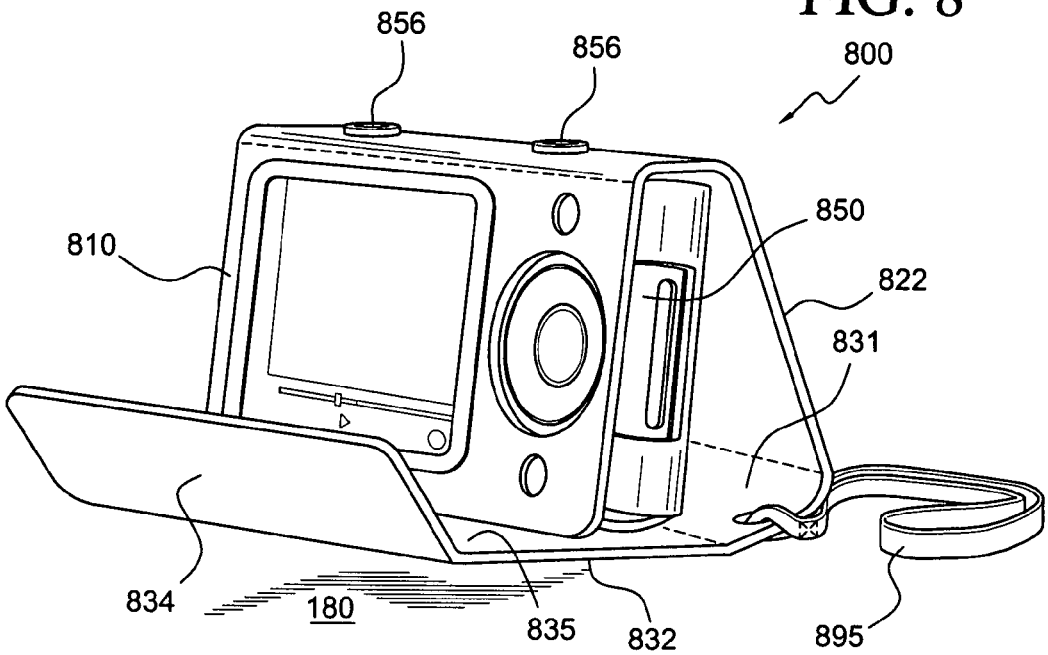
FIG. 8 illustrates a top, front, side isometric view of a case in a first embodiment of an open configuration and enclosing an electrical device, according to a third embodiment of the case.
Figure 9:
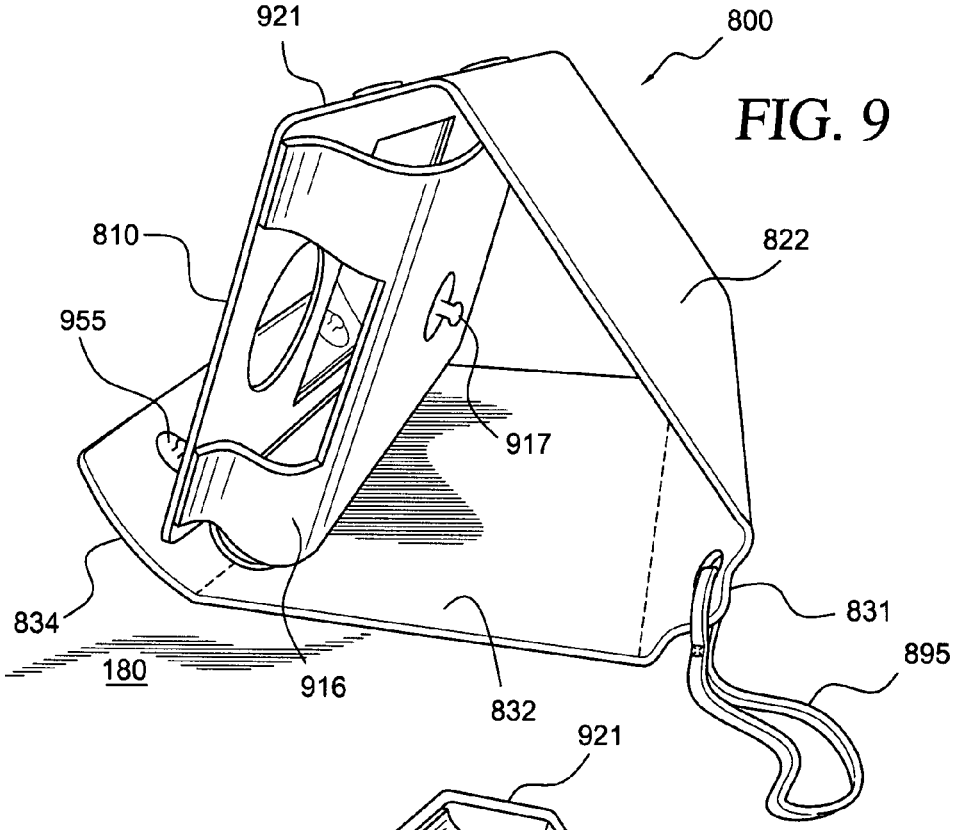
FIG. 9 illustrates a top, back, side isometric view of the case of FIG. 8 in a second embodiment of an open configuration, according to the third embodiment of the case.
Figure 10:
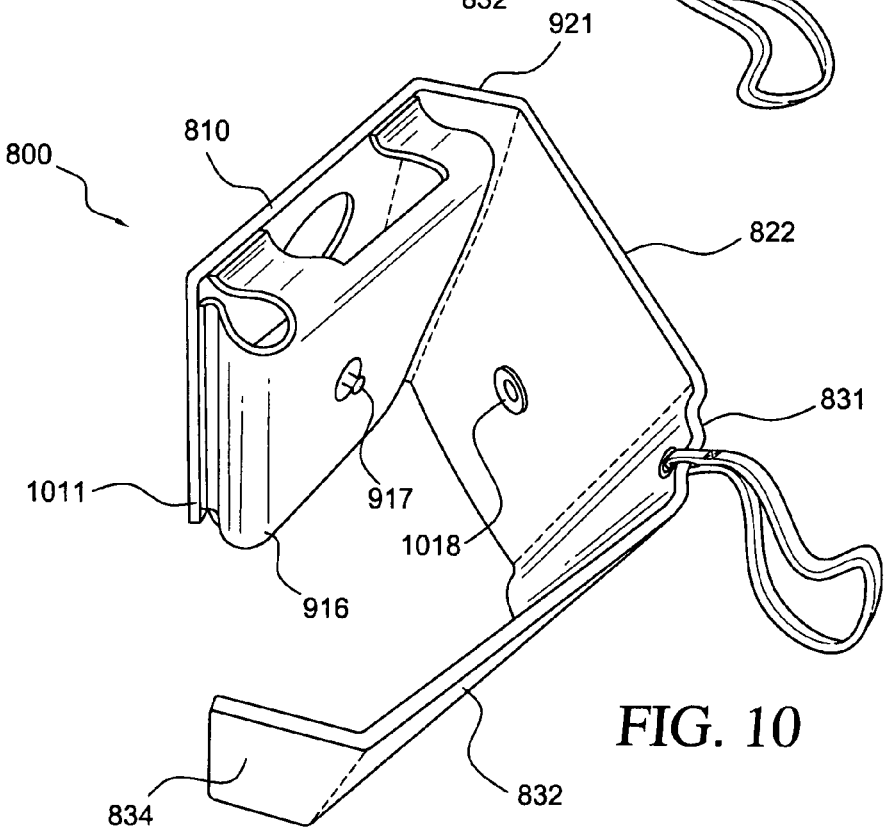
FIG. 10 illustrates bottom, side isometric view of the case of FIG. 8 in a third embodiment of an open configuration, according to the third embodiment of the case.

Turning to a further embodiment, FIG. 8 illustrates a top, front, side isometric view of a case 800 in a first embodiment of an open configuration and enclosing an electrical device 850, according to a third embodiment of case 100 (FIG. 1). FIG. 9 illustrates a top, back, side isometric view of case 800 in a second embodiment of the open configuration, according to the third embodiment of case 100 (FIG. 1). FIG. 10 illustrates a bottom, side isometric view of case 800 in a third embodiment of the open configuration, according to the third embodiment of case 100 (FIG. 1). In the embodiment illustrated in FIGS. 8-10, case 800 is configured to enclose electrical device 850. In some examples, electrical device 850 can have a different shape and/or size than electrical device 150 (FIGS. 1 and 5).

In some examples, case 800 can include: (a) an inner portion 810 with an coupling mechanism 916 and a bottom surface 1011; (b) a portion 921 adjacent to inner portion 810; (c) a portion 822 adjacent to portion 921; (d) a portion 831 adjacent to portion 822; (e) a portion 832 with an interior surface 835 and adjacent to portion 831; and (f) a portion 834 adjacent to portion 832. In some examples, case 800 does not include a portion similar to portion 133 (FIG. 1) and/or ribs 241, 242, and 343 (FIGS. 2 and 3) at portion 832. In alternative embodiments, case 800 can include portion 133 (FIG. 1) and/or ribs 241, 242, and/or 343 (FIGS. 2 and 3). When case 800 is placed in an open configuration, inner portion 810 is capable of being located over portion 832 with bottom surface 1011 adjacent to interior surface 835.

In some examples, coupling mechanism 916 can be identical to or substantially similar to coupling mechanism 116 (FIG. 1). In the same or different examples, an attachment mechanism 917 can be located at or adjacent to coupling mechanism 916. Portion 822 can include an attachment mechanism 1018 configured to be coupled to attachment mechanism 917. In some examples, portion 831 can include a coupling mechanism 895 configured to facilitate easy carrying of case 800 and electrical device 850 by a user.

Portion 834 can include a coupling mechanism 955, and a portion 921 can include a coupling mechanism 856. Coupling mechanism 955 can be configured to be coupled to coupling mechanism 856 to secure case 800 in the closed configuration. In some embodiments, attachment mechanisms 917 and 1018 can also be coupled to help hold case 800 in the closed configuration.

Figure 11:
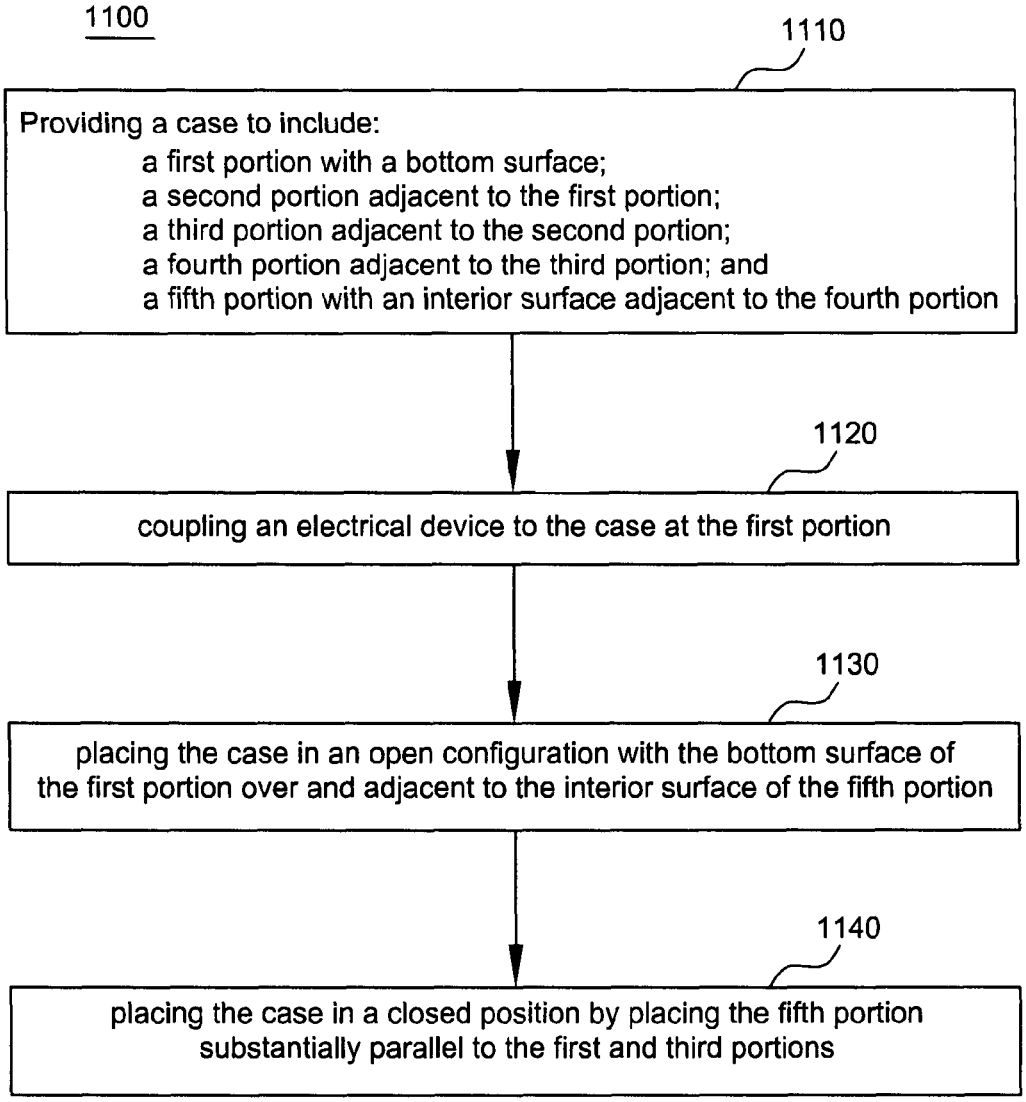
FIG. 11 illustrates a flow chart for an embodiment of a method of using a case with an electrical device.

FIG. 11 illustrates a flow chart 1100 for an embodiment of a method of using a case with an electrical device. Flow chart 1100 includes a step 1110 of providing a case to include: (a) a first portion with a bottom surface; (b) a second portion adjacent to the first portion; (c) a third portion adjacent to the second portion; (d) a fourth portion adjacent to the third portion; and (e) a fifth portion with an interior surface and adjacent to the fourth portion. As an example, the case can be similar to cases 100, 700, or 800 of FIGS. 1, 7, and 8, respectively. In some embodiments, the first portion can be similar to inner portions 110, 710 or 810 of FIGS. 1, 7, and 8, respectively. Likewise, the second portion can be similar to portions 121 or 921 of FIGS. 1 and 9, respectively. The third portion can be similar to outer portions 122, 722, or 822 of FIGS. 1, 7, and 8, respectively. The fourth portion can be similar to portions 131 or 831 of FIGS. 1 and 8, respectively. The fifth portion can be similar to portions 132 or 832 of FIGS. 1 and 8, respectively. In the same or a different embodiment, the bottom surface can be similar to bottom surfaces 111, 711, or 1011 of FIGS. 1, 7, and 10, respectively, and the interior surface can be similar to interior surfaces 235, and 835 of FIGS. 2 and 8, respectively.

Flow chart 1100 in FIG. 11 continues with a step 1120 of coupling the electrical device to the case. As an example, the electrical device can be coupled to the case similar to the coupling of electrical devices 150 and 850 to portions 110 or 810 in FIGS. 1 and 8, respectively. In an alternative example, the electrical device can be coupled to the case similar to the coupling of electrical device 150 to outer portion 722 in FIG. 7. For example, the electrical device can be coupled to the case using an attachment mechanism similar to coupling mechanisms 116, 716, or 916 of FIGS. 1, 7, and 9, respectively.

Subsequently, flow chart 1100 includes a step 1130 of placing the case in an open configuration with the bottom surface of the first portion over and adjacent to the interior surface of the fifth portion. As an example, the case can be placed in an open configuration similar to the open configuration of case 100 in FIGS. 2, 3, and 5, case 700 in FIG. 7, and case 800 in FIGS. 8 and 9. In some embodiments, placing the bottom surface of the first portion over and adjacent to the interior surface of the fifth portion can be similar to the configuration of inner portion 110, portion 132, bottom surface 111, and interior surface 235 as shown in FIGS. 2, 3, and 5. In other embodiments, placing the bottom surface of the first portion over and adjacent to the interior surface of the fifth portion can be similar to the configuration of inner portion 710, portion 132, bottom surface 711 and interior surface 235 as shown in FIG. 7. In still further embodiments, placing the bottom surface of the first portion over and adjacent to the interior surface of the fifth portion can be similar to the configuration of inner portion 810, portion 832, bottom surface 1011, and interior surface 835 as shown in FIG. 8, 9, or 10.

In some embodiments, placing the case in the open configuration can also include removably attaching the first portion to the third portion. As an example, the first portion can be removably attached to the third portion similar to the coupling of inner portion 110 to portion 122 as shown in FIG. 5.

Next, flow chart 1100 includes a step 1140 of placing the case in a closed configuration by placing the fifth portion substantially parallel to the first and third portions. As an example, the case can be placed into the closed configuration similar to the closed portion of case 100 as shown in FIG. 4. In some examples, placing the fifth portion substantially parallel to the first and third portions can be similar to the placement of portion 132 substantially parallel to portions 110 and 122, as shown in FIG. 4.

Although the invention has been described with reference to specific embodiments, it will be understood by those skilled in the art that various changes may be made without departing from the spirit or scope of the invention. For example, to one of ordinary skill in the art, it will be readily apparent portion 133 and portion 121 can include other complementary coupling mechanisms in addition to or instead of coupling mechanisms 355 and 356. Additional examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. To one of ordinary skill in the art, it will be readily apparent that the case and method of use discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A case for an electrical device, the case comprising:

a first portion with a first surface and an end adjacent to the first surface;

a second portion hingedly coupled to the first portion;

a third portion hingedly coupled to the second portion;

a fourth portion hingedly coupled to the third portion; and a fifth portion with an interior surface and hingedly coupled to the fourth portion;

a pocket for removably enclosing the electrical device and coupled to one of the first portion or the third portion, wherein:

the third portion comprises:

a first segment hingedly coupled to the second portion; and a second segment hingedly coupled to the first segment and the fourth portion;

the pocket comprises a first attachment mechanism;

the first segment comprises a second attachment mechanism;

the pocket further comprises a third attachment mechanism;

the second segment comprises a fourth attachment mechanism;

when the case is placed in an open configuration, the first portion is located over the fifth portion with the end of the first portion on the interior surface of the fifth portion;

the first attachment mechanism is configured to be coupled to the second attachment mechanism when the case is in the open configuration and the first portion is located over the fifth portion with the end of the first portion on the interior surface of the fifth portion; and the third attachment mechanism is configured to be coupled to the fourth attachment mechanism when the case is in a closed configuration.

2. The case of claim 1, wherein:

the first portion is configured to be coupled to the pocket at the first surface.

3. The case of claim 2, wherein:

the first portion allows a user to view and use the electrical device when the electrical device is coupled to the pocket, when the case is in the open configuration, and when the first portion is located over the fifth portion.

4. The case of claim 1, wherein:

the third portion comprises an interior surface; and the third portion is coupled to the pocket at the interior surface.

5. The case of claim 1, wherein:

the second portion and the fifth portion are configured to provide support to the first portion when the ease is in the open configuration and the first portion is located over the fifth portion with the end of the first portion on the interior surface of the fifth portion.

6. The case of claim 1, further comprising:

one or more supports adjacent to the interior surface of the fifth portion.

7. The case of claim 6, wherein:

at least one of the one or more supports is configured to maintain the case in the open configuration when the first portion is located over the fifth portion and the end of the first portion is on the interior surface of the fifth portion.

8. The case of claim 6, wherein:

the one or more supports comprise two or more supports;

a first direction is parallel to a width of the interior surface of the fifth portion; and the two or more supports extend in the first direction and are substantially parallel to each other.

9. The case of claim 6, wherein:

a first support of the one or more supports is separated from a second support of the one or more supports by approximately ten to twenty millimeters.

10. The case of claim 1, wherein:

when the case is in the open configuration and the first portion is located over the fifth portion with the end of the first portion on the interior surface of the fifth portion, the first portion forms a first angle with the third portion, the third portion forms a second angle with the fifth portion, and the fifth portion forms a third angle with the first portion; and the first angle, the second angle, and the third angle are acute angles of a triangle.

11. The case of claim 1, wherein:

the first portion further comprises the pocket.

12. The case of claim 1, further comprising:

a sixth portion adjacent to the fifth portion.

13. The case of claim 12, wherein:

the sixth portion comprises a first coupling mechanism;

the second portion comprises a second coupling mechanism; and the first coupling mechanism is configured to be coupled to the second coupling mechanism to secure the case in the closed configuration.

14. The case of claim 12, further comprising:

a seventh portion adjacent to the sixth portion, wherein:

the seventh portion comprises a first coupling mechanism;

the third portion comprises a second coupling mechanism; and the first coupling mechanism configured to be coupled to the second coupling mechanism to secure the case in the closed configuration.

15. The case of claim 1, wherein:

a bend region separates the first segment from the second segment; and the first segment is configured to be bent relative to the second segment at the bend region.

16. The case of claim 1, wherein:

the first portion further comprises a front surface opposite the first surface; and when the case is placed in the closed configuration, the front surface of the first portion is substantially parallel to the interior surface of the fifth portion.

* * * * *

UNITED STATES PATENT AND TRADEMARK OFFICE

CERTIFICATE OF CORRECTION

PATENT NO. : 7,735,644 B2
APPLICATION NO. : 11/810823
DATED : June 15, 2010
INVENTOR(S) : Saharut Sirichai and Xin Fu It is certified that error appears in the above-identified patent and that said Letters Patent is hereby corrected as shown below:

At column 11, line 62, delete "ease" and insert --case--.

Signed and Sealed this

Thirty-first Day of August, 2010

David J. Kappos

David J. Kappos
*Director of the United States Patent and Trademark Office*